United States Patent [19]

Gellert

[11] 4,234,080

[45] Nov. 18, 1980

[54] COLLAPSIBLE CONTAINER

[76] Inventor: Jobst U. Gellert, 11 Newton Rd., Brampton, Ontario, Canada

[21] Appl. No.: 38,671

[22] Filed: May 14, 1979

[51] Int. Cl.[3] ..... A45C 11/00; B65D 11/20

[52] U.S. Cl. ..... 206/0.82; 206/445; 220/4 B

[58] Field of Search ..... 206/0.82, 0.83, 0.84, 206/445; 220/4 B

[56] References Cited

U.S. PATENT DOCUMENTS

| | | | |
|---|---|---|---|
| D. 148,685 | 2/1948 | Foier | 206/0.83 |
| 3,069,001 | 12/1962 | Burdick | 206/0.83 |
| 3,284,025 | 11/1966 | Fridolph | 206/0.83 |
| 3,420,359 | 1/1969 | Cochrane | 206/0.82 |
| 3,981,395 | 9/1976 | Dalgleish | 206/0.83 |
| 4,139,093 | 2/1979 | Holmes | 206/0.82 |

FOREIGN PATENT DOCUMENTS

| | | | |
|---|---|---|---|
| 1286149 | 5/1970 | United Kingdom | 206/607 |

*Primary Examiner*—Joseph Man-fu Moy

*Attorney, Agent, or Firm*—George H. Riches and Associates

[57] ABSTRACT

The invention comprises a rectangular plastic sheet which may be folded about living hinges to provide a container for holding coins and the like. The sheet is made of polypropylene or other suitable plastic material which has good living hinge qualities in thin sections. The preferred embodiment consists of three V-shaped units separated by two living hinges, which units when folded form a regular hexagonally cross-sectioned cylinder. Ledging may be provided on the end of the sheet so that when folded the ledging at least partially closes the otherwise open ends of the cylinder. A locking mechanism comprising an upwardly extending lip on a side edge of the sheet which engages a hollow behind and beneath a downwardly extending lip on the other side edge is provided. By forcing contact by the coins against the container walls when the container is closed the material is tightened against the coins and the locking mechanism becomes more tightly engaged, securing against accidental opening. Because of the construction, less plastic is needed to make this container than known horseshoe-cross-sectioned coin holders.

10 Claims, 6 Drawing Figures

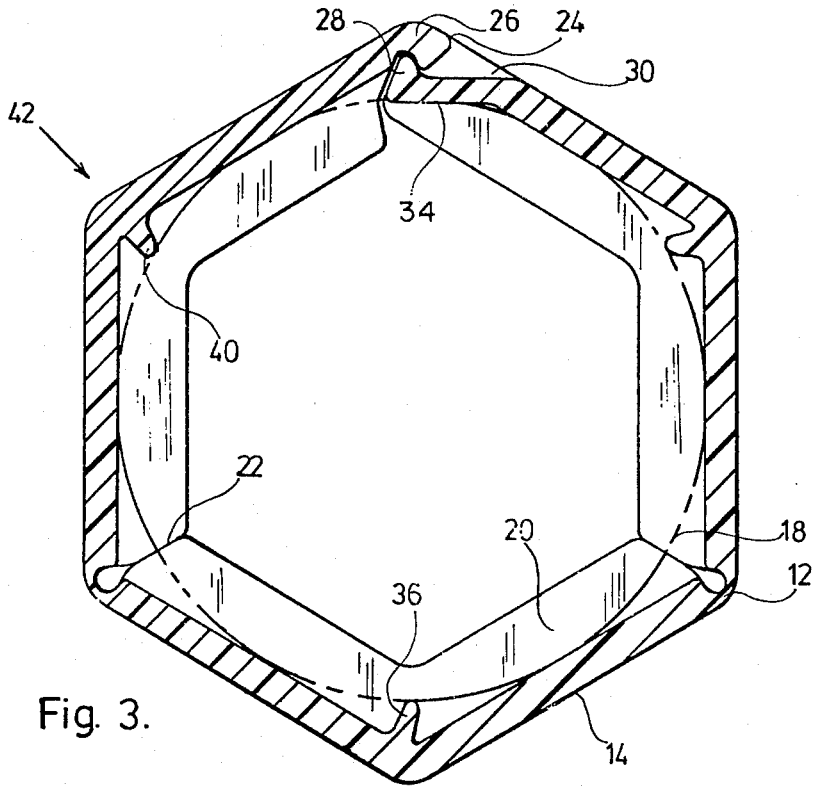
Fig. 3.
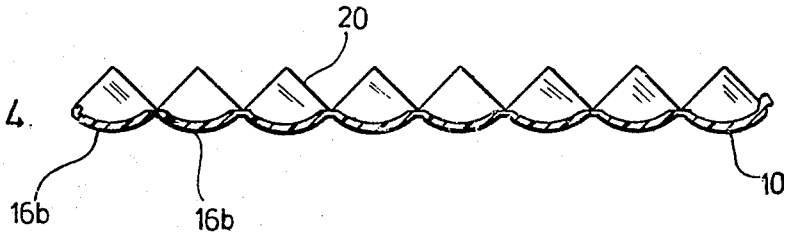
Fig. 4.
Fig. 5
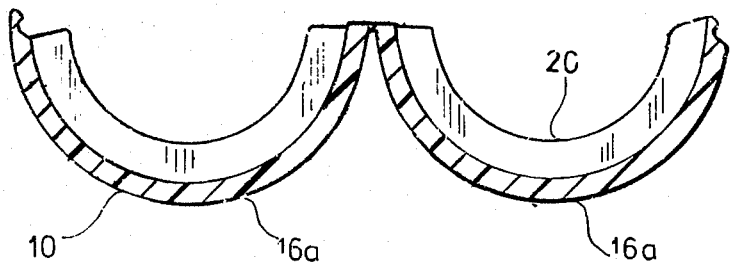

COLLAPSIBLE CONTAINER

BACKGROUND OF THE INVENTION

This invention relates to containers which may be readily constructed from or dismantled into a relatively flat rectangular sheet for economical storage when not being used as containers. These containers are generally regular polygonal in cross-section and tubular in shape. A most appropriate use is for the holding of coins in units used by the banks for "rolling", i.e., pennies or dimes in units of 50, nickels or quarters in units of 40. Of course, the use of these containers is not restricted to the holding of coins. Any other tubular article which needs packaging or protection in handling or shipping could be safely secured in one of these containers. In order to simplify the discussion of the use and construction of the container, and the sheets which are used to construct them, reference shall be made to the containers as coin holders.

Coin holders are presently known and are used by banking institutions throughout the world. Mostly, however, the holders used when coins are stored in manageable amounts are paper rolls with reinforced ends which are wrapped about the coins by machines. Even before these rolls, simple paper strips have been used to wrap the coins. The ends of the paper strips were folded against the ends of the rolled coins to keep them in place. More recently, as promotional gimmicks, some banks are dispensing plastic coin holders which are formed with a horseshoe cross-section out of a fairly thick rigid plastic.

The two types of paper rolls have several drawbacks. Neither roll is reuseable and therefore a new capital outlay is required every time the coins are to be rewrapped. The paper roll requiring the machine to roll the coins is unavailable for use to those without a proper machine. The other paper strips are generally clumsy to work with.

The plastic holders are reusable and can be used without the requirement or aid of a machine. They are expensive, though, as they must be sturdy enough to retain their shape when coins are inserted to prevent their falling out. This strength requirement means that a sufficiently large amount of plastic must be used to meet the specifications.

A container is therefore required which is cheap to make, reuseable and easy to use.

SUMMARY OF THE INVENTION

Accordingly, it is an object of the present invention to at least partially overcome the above noted disadvantages by providing a container for holding coins and the like which consists of a rectangular sheet divided into at least two units by at least one living hinge.

Some plastic products, such as polypropylene, when injection molded in very thin sections are extremely pliable. They can be repeatedly bent without displaying any indication of wear or fatigue. These thin sections are commonly called "living hinges" by those familiar with the injection molding art. Therefore, if the units are made out of any suitable molding material which has living hinge properties in thin sections, such as polypropylene, then by reducing the thickness of the plastic along certain lines the hinge can be created in the same step as the molding of the unit. Because the rest of the units are thicker than the hinge portion, they will be more rigid, providing strength for the structure.

If the units are concave, then they are arranged so that their concavities are all oriented in the same direction when the sheet is open. Therefore, when the sheet is folded to form the container, the concavities will all be inwardly directed towards the center of the container.

A locking mechanism of some sort must be available, most likely along the side edges, which can be used to retain the container closed. The mechanism should also be reversible so that the container may be opened and reused without having to replace the locking mechanism.

Because the sheet is generally flat, when it is folded to form a container it will not have any covering over the ends of the container. If it is desirable to provide closings over the ends of the container then thin ledges extending inwardly from the end edges of each unit can be provided. When the sheet is folded, the ledges will extend at least partially over the openings in the top and bottom of the container.

The most preferred embodiment of the invention, so far as the inventor feels with respect to the use of the container for holding coins, is one where the container is a regular hexagon in cross-section. There are three V-shaped units separated by two living hinges. The sheet is made entirely out of polypropylene, because of its superior physical properties, by injection molding means. There is no special technique employed in the molding process by the applicant that is not generally known to those skilled in the injection molding art.

Three V-shaped units and two hinges are preferred instead of six flat units and five hinges as, although both as well as others are useable, the V-shape allows the coins to sit therein for extra ease in the filling of the container. If one wanted to use the container with an object which might not conveniently fit in such a V-shape groove, then there could be provided a sheet with a plurality of smaller units and hinges which could more closely mirror the shape of the object. Of course, the number of hinges needed is one less than the number of units.

The container can make use of the ledges, used as partial end coverings, to provide additional strength to the shape of the container so as to further increase protection of the objects being contained. If the ledges just slightly contact each other in the folded state, that is, when the sheet is folded as a container, then their abutting each other will tend to keep the shape of the closed container rigid where the ledges are attached to the units. This strength is partly shared down the entire length of the container.

Protrusions may be provided in the V-centers to provide additional contact between the contained object and the container to add further strength at those points where the walls of the container extend away from the object inside.

BRIEF DESCRIPTION OF THE DRAWINGS

Further objects and advantages of the invention will appear from the following description taken together with the accompanying drawings in which:

FIG. 3 is a sectional view of the preferred embodiment in FIG. 2, FIGS. 4 and 5 are sectional views of other embodiments of the invention showing the container in its open state.

DETAILED DESCRIPTION OF THE DRAWINGS

Figure 1:
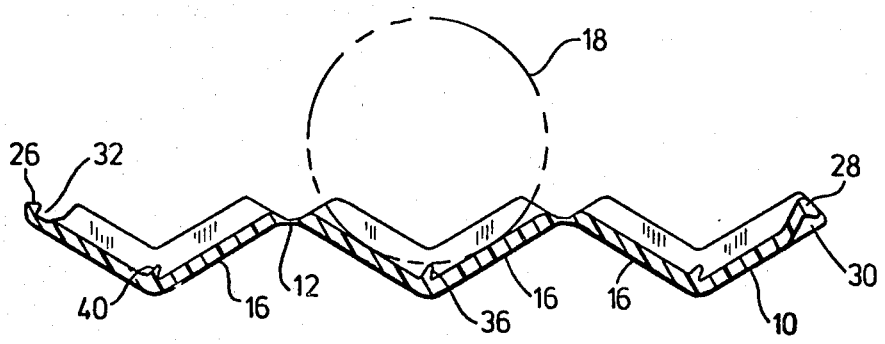
FIG. 1 is a sectional view of a preferred embodiment of the container in its open state.

Reference is first made to FIGS. 1 and 3 showing a sheet 10 which when folded about the living hinges 12 creates the container 14. These figures show preferred embodiments of the invention and are not meant to be a disclaimer of the more general concept of the invention. As can be seen, FIGS. 4 and 5 show other embodiments of the invention showing similar and different features.

Figure 2:
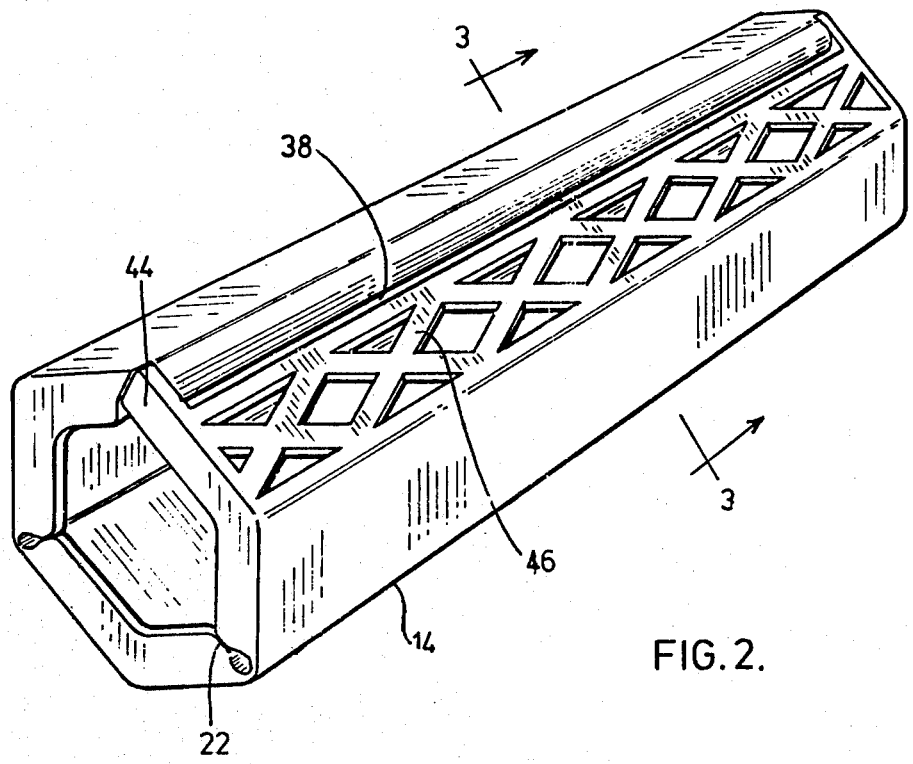
FIG. 2 is a perspective view of the embodiment shown in FIG. 1 of the container in its closed state.

The embodiment in FIGS. 1 to 3 shows the sheet 10 made up of three identical units 16 each V-shaped so that when folded about the living hinges 12 they produce the hexagonally cross sectioned container 14 as in FIG. 2. The V-shape allows the coins or other object 18 to be easily positioned for filling the container before closing.

Other shapes are as readily useable with the present invention. FIGS. 5 and 4 show a container comprising two semicircular units 16*a* and a container made up of a plurality of units 16*b* respectively. The great advantage of the hexagonal shape is that it stacks easily in uniform patterns and can sit steady on a flat surface.

The coin holders presently being used are horseshoe shaped and as a result require the addition of studs along the bottom to keep them in an upright position when lying on a flat surface. These studs then interfere with the stacking of a plurality of containers in a large shipping unit. The hexagon shape also allows locking mechanism 24 to be tucked away so as to provide a regular hexagon without any protrusions therefrom, while at the same time permitting the upper and lower locking lips 26, 28 to be substantially the same thickness as the rest of the wall of the unit 16.

Making reference to FIGS. 1 and 3, the hexagon shape preferred by the applicant when folded in the container form is only about one-third as high as the completed container. The horseshoe shaped plastic containers presently known are almost as large as the present folded containers. The stacking height of the sheets 10 would be even less than the actual height. Therefore, it would be possible to store perhaps five or six sheets 10 to each three horseshoe containers (the sheet 10 is about three times as wide as the known container) when both are empty. When full, the more regular shape of the hexagon container would probably again be at least if not more efficiently packed than the known containers of thicker plastic (to provide the additional strength required by their shape) and more irregular shape. The present invention would also be lighter per unit as it can be made with less material due to its more efficient use of material. Costs would therefore be saved in weight and volume when shipped or stored.

Ledging 20 is provided along each end edge of the sheet 10 so that when the sheet is closed the ledging 20 provides at least a partial covering over the open ends of the container. It can be noted in FIG. 3 that the ledgings 20 on adjacent units 16 just slightly touch along face 22. This provides additional rigidity at the ends of the container when closed. It is important that the container have extra strength at this point for if the container were to accidently open along the locking mechanism 24, it is most likely that it would open at one of the ends rather than at some point along the length of the container. By applying additional strength at the ends the possibility of an accidental opening is reduced. The added strength at the ends is also in part transferred down the length of the container due to the inherent strength of the material being used. An additional piece of ledging 30 can be provided to smooth out the hexagonal shape around the locking mechanism 24.

In the presently disclosed preferred embodiment the material used is polypropylene. This plastic may be easily injection molded using standard procedures to produce the present invention. It provides the necessary strength in the walls of the units 16 to protect the objects in the container when used in sufficient thickness. The thickness of the walls will be dictated by the degree of protection required for the object being contained.

Polypropylene also has very good living hinge qualities in thin sections. The physical properties of the plastic allow the hinge to be bent an unlimited number of times without affecting the strength of structure in the hinge area. The invention should not be restricted to polypropylene, or even plastics, but it is preferred to use a plastic with good living hinge qualities in thin sections.

If the locking mechanism 24 is also made of polypropylene, then the entire unit could be injection molded in one step. There is no reason why the units can not be made out of metal walls, cloth hinges glued to the walls and a separate locking mechanism attached to the metal walls. This is of course a more complicated and hence more costly construction, as well as probably weaker, than an injection molded polypropylene one. Actually, any plastic which is good molding material and has living hinge properties in thin sections is preferred over other structures.

Because polypropylene is opaque, if it is desirable to view the contents of the container then an opening will have to be provided in the walls of the units 16. To provide maximum wall strength with a minimum thickness of material, it is best that the opening comprises a weave-type pattern 46 rather than a single large opening as the weave will retain most of the strength in the wall that might otherwise be lost by removing a larger whole section. A proper weave pattern would also allow each individual coin to be seen without opening, to ensure proper filling of the container. If an opening is to be provided, it is best to provide it on the wall adjacent the lower lip 28. This wall is more strongly reinforced because of the stress from upper lip 26 than any other wall and so can be more safely weakened by an opening. Alternatively, one might consider using a clear plastic, such as K-RESIN (Trade Mark of Philips Petroleum, a polystyrene based material having living hinge qualities in thin sections) which eliminates the need for an opening to see the contents.

The locking mechanism 24 which the applicant prefers over all others is that as shown in FIGS. 1 and 3. When used with the hexagonal shape, the mechanism 24 can be shaped to fill one of the corners of the hexagon rather than to protrude out from the hexagon to interfere with its symmetry. One of the biggest problems with the present invention is to provide a locking mechanism which will be easy to make, easy to open and close and yet provide a good closure so as to avoid accidental openings because of external pressures being applied to the outside of the container.

From FIGS. 1 and 3 it can be seen that the preferred locking mechanism 24 comprises an upper lip 26 and a lower lip 28. These lips run almost the length of the container. The upper lip extends downward from the wall of the unit 16 providing a gap 32 into which the upwardly (when the sheet is folded) extended lip 28 can be inserted. The two lips need not fit so as to be independently lockable together. Instead, the upper lip 26 need merely provide an interference for the lower lip 28 so that lower lip 28 cannot be removed from gap 32 unless the upper lip 26 is raised or the lower lip 28 is lowered. When the container is full the lower lip will engage the coin 18 or whatever at surface 34 so as to prevent the lower lip from being dropped down out of gap 32. If the gap 32 is slightly inwardly directed then an even better interference between upper lip 26 and lower lip 28 can be achieved.

By constructing the container to be such a size so that the walls of the units 16 slightly engage the coins 18 at the midpoints of the walls of the units 16, then there is little or no play in the sheet 10 to allow the upper lip 26 to freely come away from the lower lip 28 unless they are intentionally forced apart by pulling lip 26 over lip 28. Because the entire structure is made of a pliable plastic, it is possible to stretch the lips into contact with each other wherefrom they cannot easily be accidentally disengaged.

If the ledging 20 is properly constructed, the contact between adjacent ledgings along faces 22 will also stress the plastic at the ends of the container to reduce the pliability of the plastic at the ends. Therefore, there is less likelihood of the lips separating at the ends, where it is normally most likely to happen.

As can be seen in FIG. 3, the locking mechanism 24 does not extend the entire length of the container in the most preferred embodiment. Instead, it stops where the ledging 20 begins. By extending the ledging on the unit carrying the lower lip 28, indicated by reference numeral 44, and respectively shortening it on the unit carrying the upper lip 26, then the locking mechanism is not accessible from the end of the container. This may be preferred in some cases so as to prevent accidental dislodging the upper and lower lips 26, 28 from the side.

Ribbing 36 can be added in the corners of the hexagon, the bottom of the V's in each unit 16. This ribbing 36 will provide still further contact with the object being contained and the container. As a result, additional stretching of the sheet 10 will occur to provide a tighter fit between the lips 26 and 28. This will also prevent the application of pressure along one of these points, such as may occur by dropping the container on a corner, from pushing the wall of unit 16 in at this point. If the wall is pushed in at this point the entire sheet 10 would tend to stretch outwardly. This may increase the play between the sheet 10 and the contained material allowing the upper lip 26 to disengage itself from the lower lip 28 and so open the container. This ribbing 36 might also be provided along those corners not in the bottom of the V's of the units 16 for extra stability in situations of accidental application of force at these points.

Because of all the protection given to the locking mechanism 24 to prevent its accidental openings, it may be that it will prove rather difficult to intentionally open. A recess 38 may therefore be provided to allow room to insert a fingernail, pen tip or the like to aid in opening the container 14.

Along the same line, it has been noted that ribbing 36 can be added to provide extra stretch in the sheet 10 and to prevent accidental opening if force is applied at one of the corners of the hexagon. If it is determined that the recess 38 is not a sufficient aid to intentionally open the container 14, then one of the ribbings 36, the one nearest the upper lip 26, ribbing 40, may be omitted. Then if force is intentionally applied in the direction of arrow 42 the sheet 10 will stretch and the upper lip 26 will, with a little help from a fingernail or the like in recess 38, become more easily separable from lower lip 28 so as to open the container. Pressure against any corner without ribbing 36 will likewise aid in opening the container.

Alternately, instead of eliminated ribbing 40, the same may be so constructed as to bend under the direct force along the direction indicated by arrow 42. This means that the ribbing 40 will provide some stress to the sheet 10 when the container is just normally being handled, but also has sufficient flexibility so as to allow the correctly applied force to assist in opening the container 14.

Figure 6:
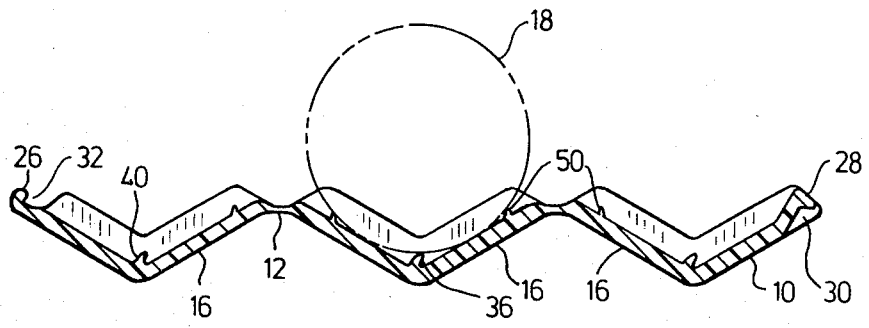
FIG. 6 is a sectional view of another embodiment of the invention showing the container in its open state.

FIG. 6 shows an embodiment of the invention with additional ribbing 50 which in addition to providing more strength to the container and more even pressure on the coins in the closed position, together with central rib 36 form a three-point rest or support for the coins when loading them in the position shown.

Although the description of this invention has been given with respect to particular embodiments, it is not to be construed in a limiting sense. Many variations and modifications will now occur to those skilled in the art. For a definition of the invention, reference is made to the appended claims.

What I claim is:

1. A manually closable and openable elongated container having first and second ends for holding coins and the like thereinbetween comprising:

(a) a sheet of molded material having first and second parallel side edges and first and second end edges extending between said side edges in respective parallel planes extending substantially perpendicularly to said side edges, the sheet being divided into at least three segments by at least two hinge means running between the end edges of the sheet substantially parallel to the side edges, said segments having a V-shaped cross-section in the open position and the container has a regular polygonal cross-section in the closed position, (b) releasable engagement means located along the first and second side edges for engaging the side edges when the sheet is bent about the at least two hinge means whereby a container in a releasably closed position is formed, and (c) ledge means extending inwardly from at least a portion of each of the first and second end edges to form at least partial covers over the ends of the container when in the closed position.

2. A container as claimed in claim 1 wherein the engagement means comprises an upwardly projecting first lip extending along the first side edge of the sheet and a downwardly projecting second lip extending along the second side edge of the sheet, the first and second lips being adapted to releasably engage each other in the closed position.

3. A container as claimed in claim 2 wherein the segments and hinge means are all of identical sizes and shapes.

4. A container as claimed in claim 1 wherein the container has a hexagonal cross-section in the closed position.

5. A container as claimed in claim 1 wherein a longitudinal rib extends along the center of at least one of the segments in a direction parallel to the side edges, the rib projecting inwardly to contact the coins or the like contained in the container when in the closed position.

6. A container as claimed in claim 2 wherein each of the segments has a longitudinal rib extending along the center thereof in a direction parallel to the side edges, the rib projecting upwardly to contact the coins or the like contained in the container when in the closed position, with the exception of the segment adjacent the second lip.

7. A container as claimed in claim 3 wherein the sheet is formed of polypropylene or a polystyrene based material.

8. A container as claimed in claim 3 wherein the ledge means on each end edge of the sheet is broken into separate ledge portions, one on each segment, the ledge portions on adjacent segments being substantially in contact in the closed position.

9. A container as claimed in claim 3 wherein longitudinal ribs extending parallel to the side edges are located on the segments on each side of the hinge means.

10. A container as claimed in claim 1 wherein the sheet is molded of polypropylene plastic, and being divided into similar first, second and third segments by first and second hinge means, the V-shaped cross-section being substantially 120°;

the first segment extending between an upwardly projecting first lip running along the first side edge of the sheet and the first hinge means, the second segment extending between the first and second hinge means, and the third segment extending between the second hinge means and a downwardly projecting second lip running along the second side edge of the sheet, the first and second lips being releasably engageable with the coins in the container in the closed position, the segments each being in contact with the coins on both sides of each hinge means; and each segment having a said ledge means and the ledge means of adjacent segments being in substantial contact in the closed position.

* * * * *